United States Patent [19]

Woron

[11] 3,978,755

[45] Sept. 7, 1976

[54] FREQUENCY SEPARATOR FOR DIGITAL MUSICAL INSTRUMENT CHORUS EFFECT

[75] Inventor: Robert P. Woron, Allentown, Pa.

[73] Assignee: Allen Organ Company, Macungie, Pa.

[22] Filed: Apr. 23, 1974

[21] Appl. No.: 463,218

[52] U.S. Cl. ..... 84/1.24; 84/DIG. 4

[51] Int. Cl.[2] ..... G10H 1/04; G10H 5/02

[58] Field of Search ..... 84/1.01, 1.03, 1.24, 84/1.25, DIG. 4, DIG. 5

[56] References Cited

UNITED STATES PATENTS

| | | | |
|---|---|---|---|
| 3,740,450 | 6/1973 | Deutsch | 84/1.24 |
| 3,743,755 | 7/1973 | Watson | 84/1.01 |
| 3,749,837 | 7/1973 | Doughty | 84/1.01 X |
| 3,755,608 | 8/1973 | Deutsch | 84/1.01 |
| 3,757,022 | 9/1973 | Markowitz | 84/1.25 |
| 3,794,748 | 2/1974 | Deutsch | 84/1.24 |
| 3,809,786 | 5/1974 | Deutsch | 84/1.01 |
| 3,809,788 | 5/1974 | Deutsch | 84/1.01 |
| 3,809,789 | 5/1974 | Deutsch | 84/1.01 |
| 3,809,790 | 5/1974 | Deutsch | 84/1.01 |
| 3,809,792 | 5/1974 | Deutsch | 84/1.24 |
| 3,816,637 | 6/1974 | Whitefield | 84/1.24 |
| 3,882,751 | 5/1975 | Tomisawa et al. | 84/1.01 |
| 3,884,108 | 5/1975 | Deutsch | 84/1.24 |

*Primary Examiner*—Stanley J. Witkowski
*Attorney, Agent, or Firm*—Seidel, Gonda & Goldhammer

[57] ABSTRACT

To provide a chorus effect in a digital musical instrument frequency separation between tones read out of two or more memories is effected by modifying the coded digital number which controls the rate of change of voice addresses in a memory by a predetermined value to produce a modified coded digital number, and then using said coded digital number and the modified coded digital number to read voices out of two or more memories.

6 Claims, 2 Drawing Figures

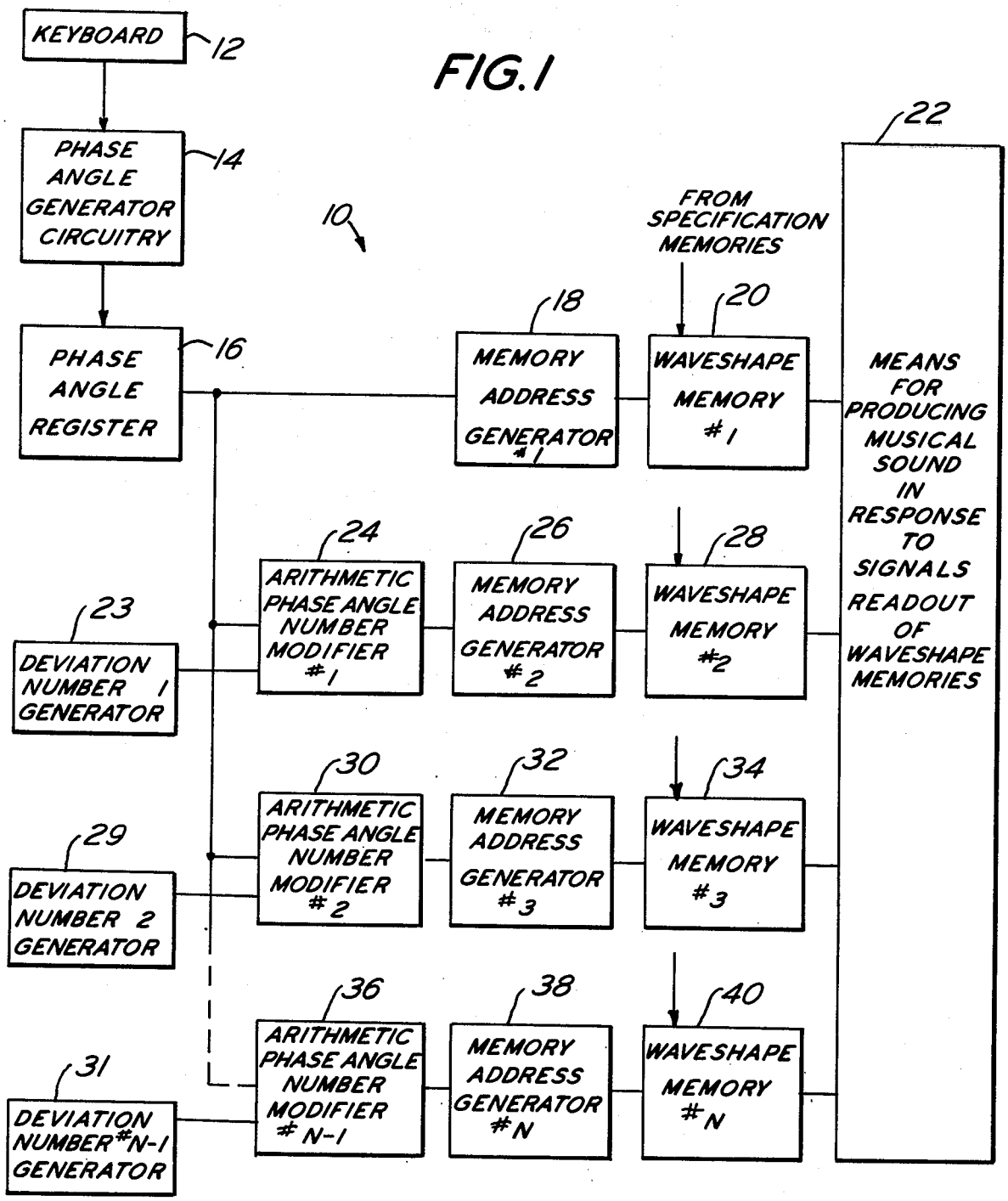
FIG. 1
KEYBOARD
12
PHASE ANGLE GENERATOR CIRCUITRY
14
10
PHASE ANGLE REGISTER
16
FROM SPECIFICATION MEMORIES
18
MEMORY ADDRESS GENERATOR #1
20
WAVESHAPE MEMORY #1
22
MEANS FOR PRODUCING MUSICAL SOUND IN RESPONSE TO SIGNALS READOUT OF WAVESHAPE MEMORIES
23
DEVIATION NUMBER 1 GENERATOR
24
ARITHMETIC PHASE ANGLE NUMBER MODIFIER #1
26
MEMORY ADDRESS GENERATOR #2
28
WAVESHAPE MEMORY #2
29
DEVIATION NUMBER 2 GENERATOR
30
ARITHMETIC PHASE ANGLE NUMBER MODIFIER #2
32
MEMORY ADDRESS GENERATOR #3
34
WAVESHAPE MEMORY #3
31
DEVIATION NUMBER #N-1 GENERATOR
36
ARITHMETIC PHASE ANGLE NUMBER MODIFIER #N-1
38
MEMORY ADDRESS GENERATOR #N
40
WAVESHAPE MEMORY #N

FREQUENCY SEPARATOR FOR DIGITAL MUSICAL INSTRUMENT CHORUS EFFECT

This invention relates to a frequency separator for a digital musical instrument. More particularly, this invention relates to the production of frequency separation in digital musical instruments to create a chorus or ensemble effect. Chorus effect results when two or more independent frequency generation sources are utilized in an electronic musical instrument system. This means that for a given musical frequency, the plurality of frequency sources for that particular musical frequency will exhibit very small deviations in frequency when the various sources are compared to each other.

Digital organs use a novel principal to faithfully reproduce, by electrical means, the sounds or tones developed in a true pipe organ. In this type of organ, a digital representation of an organ pipe wave shape is stored in a memory. A frequency synthesizer activated by a key on a manual or a pedal produces a digital number representative of the desired frequency. This digital number is used to repetitively read the digitized wave shape out of the memory at the note frequency selected by depression of the key or pedal. This is then converted to analog form to produce a musical tone having a wave shape corresponding to that stored in memory. For a full description of the function and operation of a digital organ, reference is made to U.S. Pat. Nos. 3,515,792, issued June 2, 1970, 3,610,799, issued Oct. 5, 1971 and 3,639,913, issued Feb. 1, 1972.

For purpose of the present invention is to produce the chorus (or ensemble) effect in a digital organ. More particularly, the present invention seeks to provide the chorus effect in existing digital organs using basically the same electronic hardware and with only a moderate addition to the circuitry. Past attempts have involved complete duplication of tone generating systems. Thus, the present invention seeks to provide the chorus effect in a digital organ while maintaining all of its basic advantages. In accordance with the present invention, the requisite frequency separation between tones for creating the ensemble effect is provided in a digital organ.

As previously indicated, it is the small deviation or separation in frequency between tones that results in the chorus effect. It has also been indicated that in a digital organ the frequency at which a stored digital wave shape representation is read out of a memory determines the tone. Therefore, to generate the requisite frequency separation or deviation between simultaneously sounding tones read out of two or more distinct memories, the frequency at which the wave shape is read out of the second memory must be varied from the frequency at which the wave shape is read out of the first memory. The present invention provides means for accomplishing this.

For the purpose of illustrating the invention, there are shown in the drawings forms which are presently preferred; it being understood, however, that this invention is not limited to the precise arrangements and instrumentalities shown.

FIG. 1 is a simplified block diagram of a first embodiment of the frequency separator for digital musical instruments.

Figure 2:
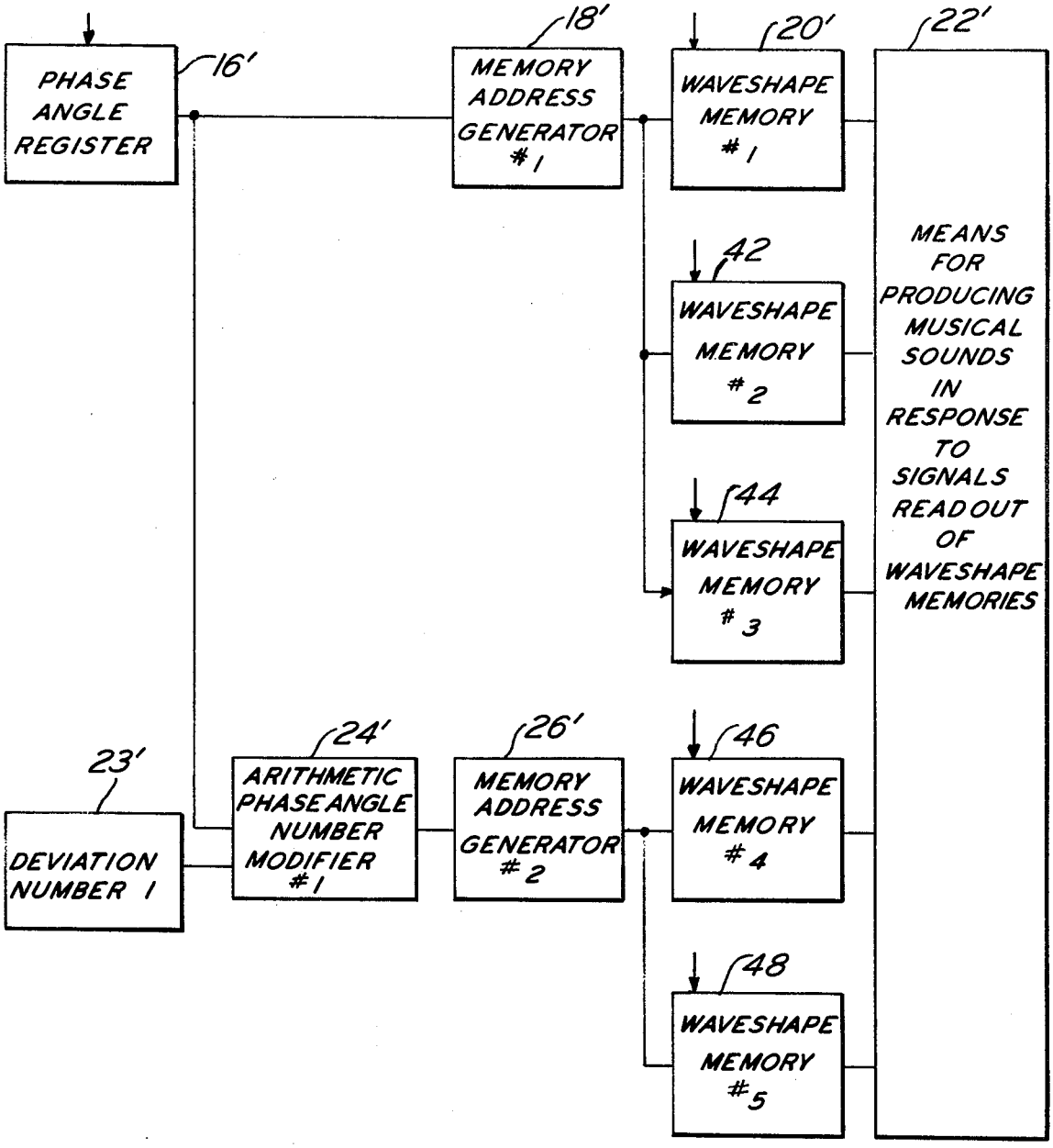
FIG. 2 is a simplified block diagram of another embodiment of the frequency separator for digital musical instruments.

Prior to describing the invention in detail, it may be helpful to briefly refer to certain prior art digital musical instruments, particularly organs, for a better understanding of the present invention. U.S. Pat. No. 3,515,792 describes an electronic musical instrument wherein an electronic musical tone is generated upon manual selection of a particular key, such as in an organ keyboard or pedal. In that patent, a tonal wave shape is stored in memory and, when repetitiously read out of memory at selected rates into a means for producing musical sound in response to these wave-shape signals, produces the selected musical note or tone. As described in Pat. 3,151,792, one or more wave shapes are subdivided into digital representation of the wave shape and stored in the memory. The digital representations are stored as a plurality of binary words, each word representing the amplitude (or amplitude increment) at respective ones of a plurality of wave shapes sample points.

The system described in U.S. Pat. No. 3,151,792 may be implemented by systems and apparatus described in U.S. Pats. 3,610,799 and 3,639,913.

In said U.S. Pat. No. 3,610,799, there is presented a method and apparatus for multiplexing keyboard switches, tone generators and means for selecting tone generators responsive to keyboard switch closures.

U.S. Pat. No. 3,610,799 also teaches the combining of voices selected by operating appropriate stops or tabs. The voices are stored in specification memories, also referred to as voice memories. The voices are read out of the voice memories and into a voicer or combiner which accumulates the combined voice data. The combined voice data is then written into an appropriate registration memory.

U.S. Pat. No. 3,639,913 describes a method and apparatus for addressing a memory at selectively controlled rates, which method can be used in a digital musical instrument to repetitiously read out a tonal waveshape from a registration memory or any other type of waveshape memory at a selected musical frequency. The tonal waveshape signals thus read out of the waveshape memory are presented to a means for producing musical sound in response to these waveshape signals as described in U.S. Pat. No. 3,515,792.

As stated in U.S. Pat. No. 3,639,913, the sample points for any particular wave form stored in a memory are preferably uniformly spaced in time. Accordingly, the phase angle between sample points of the stored wave form varies with the frequency of the note to be generated. Stated otherwise, the frequency of the note to be generated is a function of the phase angle between the sample points. In other words, the various generated tone frequencies produced are directly related to corresponding phase angles.

Apparatus for generating the appropriate phase angles corresponding to musical frequencies is described in U.S. Pat. Nos. 3,610,799 and 3,639,913.

Having described the basic functions of digital musical instrument, reference should now be made to FIG. 1 wherein there is disclosed a frequency separator for a digital musical instrument designated generally as 10. Since, as indicated above, digital organs have heretofore become known to those skilled in the art as disclosed in the referenced United States patents, and otherwise, only details sufficient to enable any person skilled in the art to make and use the invention are described herein. While the present invention is described principally in terms of an organ, is should be understood that it is equally applicable to other musical instruments where it is desirable to create a chorus effect.

The keyboard 12 may, for example, be that of an organ having as many as four keyboards, such as three manuals and a pedal board. By the use of means, such as described in U.S. Pat. Nos. 3,610,799 and 3,639,913, phase angles are generated by phase angle generator circuitry 14 and selectively retained in phase angle register 16 in response to actuation of keyboard keys.

The phase angle register 16 repetitiously presents the selected phase angle to the No. 1 memory address generator 18. The No. 1 memory address generator 18 repetitiously adds this phase angle to its previous address output and then replaces this previous address output with the resulting sum which is the new address output. See, for example, U.S. Pat. No. 3,639,913 for a detailed description of the operation of this circuitry.

The magnitude of the phase angle associated with a particular key determines the scan rate of the memory address which is the rate at which the memory address output of the No. 1 memory address generator 18 changes, and thus the magnitude of the phase angle is proportional to the frequency of the note being played.

The output of No. 1 memory address generator 18 is used to access the No. 1 wave shape memory 20 which may be a registration memory or other type of wave-shape memory.

The information thus stored in the No. 1 wave shape memory 20 is read out into known means for producing musical sound 22 in response to signals read out of wave shape memories. See the aforementioned U.S. Pat. Nos. 3,515,792 and 3,610,799 for a description of such means 22.

To provide the requisite frequency separation or deviation, the output of phase angle register 16, which is a digital phase angle number, is transferred to the No. 1 arithmetic phase angle number modifier 24 which may be, by way of example, an adder/subtractor of any conventional design. The other input to the No. 1 arithmetic phase angle number modifier is a digital deviation number independently generated by the No. 1 deviation number generator 23. The No. 1 deviation number inputted to No. 1 arithmetic phase angle number modifier 24 has a value sufficient to modify the phase angle to create a slight frequency deviation in the output of the No. 2 wave shape memory 28 with respect to the output of the No. 1 wave shape memory. The amount of such frequency deviation is chosen in accordance with well known techniques of conventional organ design to provide the requisite chorus effect.

The No. 1 arithmetic phase angle number modifier 24 adds or substracts, as desired, the No. 1 deviation number to or from the phase angle number generated by the phase angle register 16. The output of the No. 1 arithmetic phase angle number modifier is then transferred to the No. 2 memory address generator 26 which operates upon the modified phase angle number in the same manner as the No. 1 memory address generator 18. Accordingly, its function need not be again described in detail. The output of the No. 2 memory address generator 26 is transferred to the No. 2 wave shape memory 28 which functions in the same manner as the No. 1 wave shape memory 20 in that it stores a wave shape or sum of wave shapes which may or may not be the same as are stored in the No. 1 wave shape memory 20. The output of the No. 2 wave shape memory 28 is then transferred to means for producing musical sounds 22 for conversion through appropriate circuitry to an analog signal and application to an appropriate transducer (speaker).

If desired, any number of frequency separations may be generated as required by the individual musical instrument. Accordingly, No. 2 arithmetic phase angle number modifier 30, No. 3 memory address generator 32 and No. 3 wave shape memory 34 may be provided to function in the same manner as No. 1 arithmetic phase angle number modifier 24, No. 2 memory address generator 26 and No. 2 wave shape memory 28. The No. 2 arithmetic phase angle number modifier 30 is fed by No. 2 deviation number generator 29 whose output differs from deviation from deviation No. 1 as required. This process may be continued to provide a desired number N of tones exhibiting frequency separation; thus the N-1 arithmetic phase angle modifier 36, N memory address generator 38, and N wave shape memory are shown. The N-1 arithmetic phase angle number modifier 36 adds or subtracts deviation number N-1 generated by N-1 deviation number generator 31. N memory address generator 38 and N wave shape memory 40 function in the manner of their counterparts described above. Of course, each of the wave shape memories 1 through N generates an output which is processed through appropriate means 22 for producing musical sounds in response to such outputs and applied to appropriate transducers for the generation of that sound, preferably as a musical tone. The resultant independent musical tones differ from each other by the requisite frequency amount as determined by the deviation numbers 1 through (N-1).

The resultant sound has the requisite chorus effect. Moreover, it is produced through the use of only a moderate amount of additional electronic hardware. It is not necessary to provide complete new tone generators for each of the requisite signals.

Referring now to FIG. 2, there is shown another embodiment of the present invention wherein primed numerals indicate structural elements which function in the same manner as described in respect to the embodiment illustrated in FIG. 1. A phase angle register 16' retains appropriate phase angle numbers in the same manner as phase angle register 16. The output of phase angle register 16' is transferred to No. 1 address memory generator 18' and its output is transferred to No. 1 wave shape memory 20'. The output of No. 1 wave shape memory 20' is converted in appropriate means for producing musical sounds 22' as previously described.

In the embodiment shown in FIG. 2, the output of No. 1 memory address generator 18' is transferred simultaneously to three wave shape memories rather than just one. Thus, said output is transferred to No. 2 wave shape memory 42 and to No. 3 wave shape memory 44 as well as to No. 1 wave shape memory 20' as shown. The output of No. 2 wave shape memory 42 and No. 3 wave shape memory 44 is transferred to the means for producing musical sound 22 for conversion into audible musical tones.

In addition, the output of phase angle register 16' is transferred to the No. 1 arithmetic phase angle number modifier 24' which, like the No. 1 arithmetic phase angle number modifier 24, is preferably an adder/subtractor which has at its other input an appropriately selected deviation No. 1 from deviation generator 23'.

The output of No. 1 arithmetic phase angle number modifier 24′ is transferred to the No. 2 memory address generator 26′ which functions in the same manner as the No. 2 memory address generator 26 illustrated in FIG. 1. The output of No. 2 memory address generatory 26′ is transferred not to one, but to two wave shape memories, namely No. 4 wave shape memory 46 and No. 5 wave shape memory 48. The output of No. 4 wave shape memory 46 and No. 5 wave shape memory 48 is individually converted to a musical tone or the like in means for producing musical sound 22′. Wave shape memories 46 and 48 will be producing their respective tones at frequencies which deviate slightly from the frequencies generated by the wave shape memories 20′, 42 and 44 as determined by the deviation number produced by deviation generator 23′. Thus, the embodiment shown in FIG. 2 illustrates that the invention can be extended to provide frequency separation between groups of wave shaped memories.

It should be indicated that thus far it has been assumed that the deviation numbers are fixed. If desired, the deviation numbers can be made variable; that is, they can be caused to vary over a chosen range in a regulated or random manner by appropriately adding or subtracting a variable number to or form the phase angle number.

From the foregoing, it is readily apparent that frequency separation for creation of the chorus effect is provided by the use of a phase angle number modifier as described. The foregoing described structure produces as many independent sources of sound as is desired with only a moderate increase in the amount of electronic hardware necessary.

The present invention may be embodied in other specific forms without departing from the spirit or essential attributes thereof and, accordingly, reference should be made to the appended claims, rather than to the foregoing specification as indicating the scope of the invention.

I claim:

1. An electronic musical instrument having at least two wave shape memory means for storing digital representations of musical voices, means for producing at least two musical sounds in response to wave shape signals read out of said memory means, apparatus for producing a frequency separation between the musical sounds produced in response to wave shape signals read out of said wave shape memory means, comprising:

means for generating a coded digital number corresponding to the frequency of a musical note in response to the actuation of a key of the electronic musical instrument;

means for generating a first memory address signal having a scan rate proportional to said coded digital number for reading wave shape signals out of one of said memory means at a rate proportional to said scan rate;

digital arithmetic means for changing the coded digital number output of said number generator by a predetemined value to produce a second coded digital number; and means for generating a second memory address signal having a scan rate proportional to said second coded digital number for reading wave shape signals out of another memory means at a rate proportional to the scan rate of said second memory address signal.

2. An electronic musical instrument in accordance with claim 1 wherein said one wave shape memory means includes two or more wave shape memories for storing digital representations of musical voices which are read out of said memories at a rate proportional to the scan rate of said first memory address signal, and said other wave shape memory means includes two or more wave shape memories for storing digital representations of musical voices which are read out of said memories at a rate proportional to the scan rate of said second memory address signal.

3. An electronic musical instrument having two or more wave shape memory means for storing digital representations of musical voices, means for producing at least two musical sounds in response to wave shape signals read out of said memory means, apparatus for producing a frequency separation between the musical sounds produced in response to the wave shape signals read out of said wave shape memory means, comprising:

a phase angle generator for generating a coded digital number corresponding to a musical tone in response to the actuatiton of a key of the electronic musical instrument;

means for repetitively addressing one of said memory means at a repetition rate proportional to the coded digital number for reading wave shape signals out of said one memory means at a rate proportional to the address repetition rate;

digital arithmetic means for changing the coded digital number output of said phase angle generator by a predetermined value to produce a second coded digital number; and means for repetitively addressing another of said memory means at a repetition rate proportional to said changed coded digital number for reading wave shape signals out of said second memory means at a rate proportional to said address repetition rate.

4. An electronic musical instrument in accordance with claim 3 wherein said one wave shape memory means includes two or more wave shape memories for storing digital representations of musical voices and each of said two or more memory means of said one wave shape memory is simultaneously addressed at the repetition rate proportional to the coded digital number, and said other wave shape memory means includes two or more wave shape memories for storing digital representations of musical voices and each of said wave shape memories of said other memory means is simultaneously addressed at a repetition rate proportional to said changed coded digital number.

5. An electronic musical instrument having at least N wave shape memory means for storing digital representations of musical tones, where N is a preselected number, means for producing independent musical sounds in response to wave shape signals read out of said N wave shape memory means, apparatus for producing a frequency separation between the independent musical sounds produced in response to wave shape signals read out of said N wave shape memory means, comprising:

means for generating a coded digital number corresponding to the frequency of a musical tone in response to the actuation of the key of the electronic musical instrument;

means for generating a first memory address signal having a scan rate proportional to said coded digital number for reading wave shape signals out of one of said wave shape memory means at a rate proportional to said scan rate;

N−1 digital arithmetic means for changing the coded digital number output of said number generator means by preselected values to produce N−1 coded digital numbers; and N−1 means for generating N−1 memory address signals, each having a scan rate proportional to a particular coded digital number out of said N−1 coded digital numbers with which each of said N−1 means for generating a memory address signal is associated for reading information signals out of the other of said wave shape memory means at rates proportional to the N−1 scan rates of said N−1 memory address signals.

6. An electronic musical instrument having at least N wave shape memory means for storing digital representations of musical tones, where N is a preselected number, means for producing independent musical sounds in response to wave shape signals read out of said independent wave shape memory means, apparatus for producing a frequency separation between the independent musical sounds produced in response to wave shape signals read out of said N wave shape memories, wherein the chorus (or ensemble) effect is produced by the musical instrument, comprising:

means for generating a coded digital number corresponding to the frequency of a musical tone in response to the actuation of a key of the electronic musical instrument;

means for generating a first memory address signal having a scan rate proportional to said coded digital number for reading wave shape signals out of one of said wave shape memory means at a rate proportional to said scan rate;

N−1 digital arithmetic means for changing the coded digital number output of said number generator means by preselected values to produce N−1 coded digital numbers; and N−1 means for generating N−1 memory address signals, each having a scan rate proportional to a particular coded digital number of said N−1 coded digital numbers with which each of said N−1 means for generating memory address signal is associated for reading stored wave shape signals out of the other of said wave shaped memory means at rates proportional to the N−1 scan rates of said N−1 memory address signals, the differences in the values of said N−1 coded digital numbers being selected such that the frequency separation between the independent musical sounds produced in response to the wave shape signals read out of said N wave shape memory means produces a chorus (or ensemble) effect.

* * * * *